United States Patent [19]

Wang

[11] Patent Number: 4,892,542

[45] Date of Patent: Jan. 9, 1990

[54] SOCKET

[76] Inventor: Tian T. Wang, No. 26, Lane 293, Hua Cheng Rd., Hsin Chuang City, Taipei Hsien, Taiwan

[21] Appl. No.: 333,968

[22] Filed: Apr. 6, 1989

[51] Int. Cl.[4] ..... H01R 13/10

[52] U.S. Cl. ..... 439/818

[58] Field of Search ..... 439/817, 818

[56] References Cited

FOREIGN PATENT DOCUMENTS 499285 11/1950 Belgium ..... 439/818

224996 11/1924 United Kingdom ..... 439/818

*Primary Examiner*—Joseph H. McGlynn

*Attorney, Agent, or Firm*—Bacon & Thomas

[57] ABSTRACT

A socket including a casing having a number of partition plates formed on each lateral side of the socket a vertical receptacle and one or more lateral cylindrical chamber. A conducting plate is disposed in each receptacle bearing against a vertical partition plate. A protuberance set includes a cylinder, a ball and a spring both retained seriesly in the cylinder. A protuberance set is provided in each of the cylindrical chambers so that the ball slightly protrudes from the receptacle.

6 Claims, 2 Drawing Sheets

SOCKET

BACKGROUND OF THE INVENTION

The present invention relates to a socket, and more particularly, to a socket having ability to facilitate the insertion of a plug.

Since plugs and sockets are widely used in private houses, industrial plants or public buildings, people have an urgent need for good sockets.

The present invention has arisen to provide a good socket.

SUMMARY OF THE INVENTION

It is therefore a primary object of the present invention to provide a socket which facilitates the insertion and the withdrawal of a plug.

It is another object of the present invention to provide a socket which facilitates the conductive coupling between the socket and the plug.

The socket in accordance with the present invention comprises a casing having a number of partition plates formed on each of the lateral sides of the socket a vertical receptacle and at least one lateral cylindrical chamber, a conductive plate being disposed in each receptacle bearing against a vertical partition plate, and a protuberance set. The protuberance set includes a cylinder, a ball and a spring retained in series in the cylinder, being provided in each of the cylindrical chambers so that the ball slightly protrudes from the receptacle.

DETAILED DESCRIPTION OF THE PREFERRED EMBODIMENT

Figure 1:
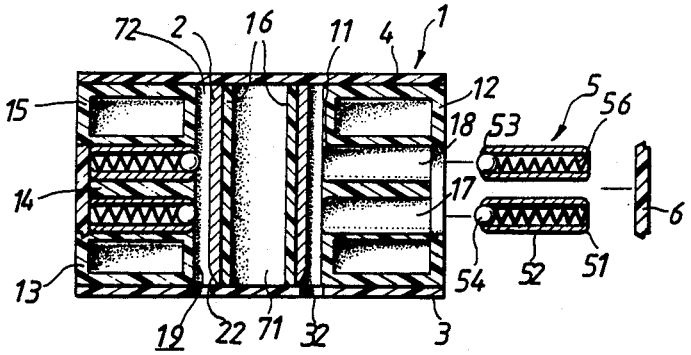
FIG. 1 is a partially exploded cross sectional view of a socket in accordance with the present invention.
Figure 2:
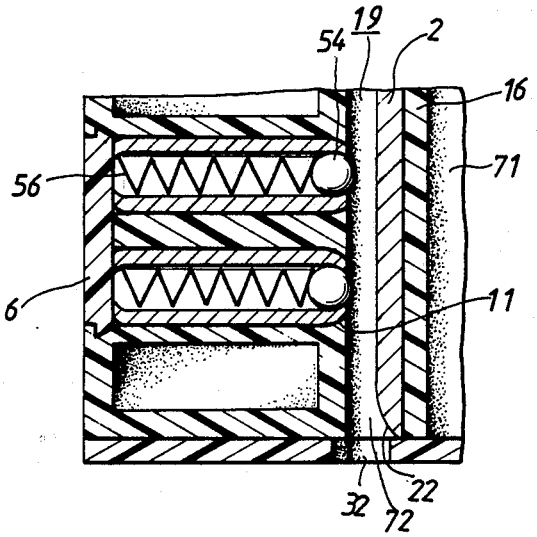
FIG. 2 is an enlarged cutaway cross sectional view of the socket of FIG. 1.
Figure 3:
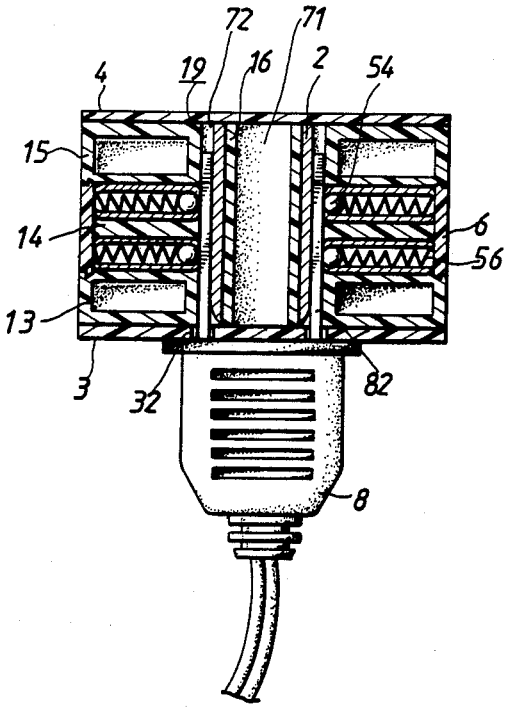
FIG. 3 is cross sectional view showing a working view of the socket of FIG. 1.

Referring to the drawings, a socket 1 in accordance with the present invention includes a casing 12 having several insulation partition plates 13, 15 to form the major configuration of the socket 1. The casing 12 has two symmetrical lateral sides separated by three consecutive compartments, one middle compartment 71 and two lateral compartments 72, which are separated by two symmetrical vertical insulation partition plates 16. Two cylindrical chambers 17, 18 are formed on each lateral side of the casing 12 and separated by a horizontal insulation partition plate 14. Two conducting plates 2 are disposed in the two lateral compartments 72 and bear against the vertical insulation partitions 16 to form respective slender receptacles 19. Each of the cylindrical chambers 17, 18 intersects vertically or at an inclination less than 90 degrees with the receptacle 19. One end of each of the conducting plates 2 has a tapered surface 22 for facilitating the insertion of a prong 82 of a plug 8. A first cover 3 with two slots 32 corresponding to the receptacle 19 and a second cover 4 are disposed on lower and upper sides of the casing 12 respectively by glue, screws, dovetail joints or simply a force-fitted joint, etc., any of which can be easily accomplished by the present technology. The first cover 3 and the second cover 4 are provided for purposes of decoration only.

A protuberance set 5 is composed of a cylinder 52, with respective balls 54 and springs 56 inserted therein. The balls 54 and springs 56 are fitted in their respective cylinders 52 so that the ball 54 slightly protrudes out of the cylinder 52 and is limited by a first converging surface or a stop 53 formed on one end of the cylinder 52. A second converging surface or a stop 51 is also provided on the other end of the cylinder 52 for retaining the spring 56 so that a suitable spring force is applied to the ball by the spring 56. A third converging surface or a stop 11 is provided on the inner end of the cylindrical chamber 17 or 18 for limiting the movement of the protuberance set 5, and a partition wall 6 is disposed on the outer end of each cylindrical chamber 17, which retains and forces the spring 56 and ball 54 into position in order that the ball 54 of the protuberance set 5 protrudes slightly from the receptacle 19. Alternatively, the ball 54 and the spring 56 could be directly fitted into the cylindrical chamber 17 or 18 without the cylinder 52. The partition wall 6 is fitted into position by glue, screw(s), dovetail joint(s) or force-fitted joint(s), etc. Besides, the whole socket 1 including the casing 12 and partition plates 13, 14, 15 and 16 could be intergrally formed by way of injection molding.

In actual use, the conducting plate 2 is connected to an electrical source (not shown). The socket is now in condition for use. The plug 8 of an electrical appliance is inserted into the socket 1. As the plug 8 is inserted into the socket 1 through the slots 32, the prongs 82 of the plug 8 are easily directed into the receptacle 19 by the help of the tapered surface 22 of the conducting plate 2. As the plug 8 is further pushed, the prongs 82 of the plug 8 are pressed by the spring 56 via the balls 54 of the protuberance sets 5 so as to reduce the contact area between the prongs 82 and the receptacle 19. Therefore, the prongs 82 of the plug 8 could be quickly pushed into position. Accordingly, the prongs 82 of the plug 8 rigidly contact their respective conducting plates 2. As a consequence, the plug 8 is connected to the electrical power source (not shown) via the prevent socket 1.

It should be noted that, as shown in the drawings, the four cylindrical chambers 17, 18 and corresponding protuberance sets 5 are shown for purposes of explanation only. One protuberance set 5 on each side of the socket 1 is good enough to achieve the desired result.

While the present invention has been explained in relation to its preferred embodiments, it is to be understood that various modifications or alterations thereof will become apparent to those skilled in the art upon reading this specification. Therefore, it is to be noted that all such modifications or alternations should be considered as falling within the scope of the appended claims.

I claim:

1. A socket comprising:

a casing having a number of insulating partition plates to form a major configuration of said socket which has two symmetrical lateral sides separated by a plurality of compartments, said compartments being separated by a plurality of vertical insulation partition plates corresponding to prongs of a plug, at least one lateral cylindrical chamber being formed on each lateral side of said casing;

a conducting plate being disposed in two of said compartments which are formed each between a lateral side of said socket and a vertical insulating partition plate, and bearing against said vertical insulating partition in order to form a receptacle between said conducting plate and said lateral side of said socket;

a ball and a spring being disposed in series in each lateral cylindrical chamber;

a partition wall disposed on each outer end of said lateral cylindrical chamber for retaining and forcing said spring and said ball into position.

2. A socket according to claim 1, wherein said conducting plate has a tapered outer end.

3. A socket according to claim 1, wherein a cylinder is provided to retain said ball and said spring in order to form a protuberance set.

4. A socket according to claim 1, wherein two lateral cylindrical chambers are formed on each lateral side of said socket.

5. A socket according to claim 1, wherein a converging surface is formed in the inner end of each of said cylindrical chambers.

6. A socket according to claim 3, wherein two converging surfaces are formed respectively in each end of said cylinder.

* * * * *